US011482193B2

(12) United States Patent
Frederick et al.

(10) Patent No.: US 11,482,193 B2
(45) Date of Patent: Oct. 25, 2022

(54) POSITIONING VIDEO SIGNALS

(71) Applicant: Hewlett-Packard Development Company, L.P., Spring, TX (US)

(72) Inventors: John Frederick, Spring, TX (US); Syed S Azam, Spring, TX (US); Timothy Guynes, Spring, TX (US); Irene Chou, San Diego, CA (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/966,038

(22) PCT Filed: Mar. 21, 2018

(86) PCT No.: PCT/US2018/023558
§ 371 (c)(1),
(2) Date: Jul. 30, 2020

(87) PCT Pub. No.: WO2019/182584
PCT Pub. Date: Sep. 26, 2019

(65) Prior Publication Data
US 2021/0035536 A1 Feb. 4, 2021

(51) Int. Cl.
*G09G 5/38* (2006.01)
*G09G 5/14* (2006.01)

(52) U.S. Cl.
CPC ..... *G09G 5/38* (2013.01); *G09G 5/14* (2013.01); *G09G 2340/0442* (2013.01); *G09G 2340/0464* (2013.01); *G09G 2354/00* (2013.01); *G09G 2370/20* (2013.01)

(58) Field of Classification Search
CPC .... G09G 5/38; G09G 5/14; G09G 2340/0442; G09G 2340/0464; G09G 2354/00; G09G 2370/20
See application file for complete search history.

(56) References Cited

U.S. PATENT DOCUMENTS

| | | | | |
|---|---|---|---|---|
| 8,363,162 | B2 | 1/2013 | Ishihara | |
| 9,335,926 | B2 | 5/2016 | Choi et al. | |
| 2007/0285565 | A1* | 12/2007 | Mizuno | H04N 5/45 348/E5.111 |
| 2010/0002069 | A1* | 1/2010 | Eleftheriadis | H04N 21/234327 348/14.08 |
| 2013/0019150 | A1 | 1/2013 | Zarom | |
| 2014/0139736 | A1* | 5/2014 | McCoy | H04N 7/0122 348/445 |
| 2015/0124170 | A1 | 5/2015 | Kenmochi et al. | |

(Continued)

OTHER PUBLICATIONS

Owner's Manual IPS LED Monitor (LED Monitor*), Feb. 29, 2016, http://www.specsserver.com/CACHE/frtailjvfnuc.pdf.

(Continued)

*Primary Examiner* — Michelle L Sams
(74) *Attorney, Agent, or Firm* — Conley Rose PC

(57) ABSTRACT

An example system includes an input engine to determine an aspect ratio of each of a plurality of video signals input to the system. The system includes an arrangement engine to determine positions in a display area for the plurality of video signals based on the aspect ratio of each video signal. The system includes a display engine to output screen content corresponding to the plurality of video signals at the determined positions.

15 Claims, 6 Drawing Sheets

300

(56) References Cited

U.S. PATENT DOCUMENTS

| | | | | |
|---|---|---|---|---|
| 2015/0358554 | A1 | 12/2015 | Cheong et al. | |
| 2015/0365306 | A1* | 12/2015 | Chaudhri ..... | G06F 3/0484 715/736 |

OTHER PUBLICATIONS

U3415W Monitor: Functionality of Picture by Picture, Mar. 8, 2017, http://www.dell.com/support/article/in/en/indhs1/sln305263/u3415w-monitor-functionality-of-picture-by-picture?lang=en.

* cited by examiner

300

400

POSITIONING VIDEO SIGNALS

BACKGROUND

Computing devices may improve the productivity of users. For example, the computing devices may perform numerous operations rapidly. The computing devices also may be able to transfer large amounts of data rapidly between users. Such rapid data transfer may improve the productivity of groups of users by improving their ability to collaborate. Indeed, such rapid data transfers may be available across multiple devices allowing efficient collaboration even across multiple devices.

DETAILED DESCRIPTION

Figure 1:
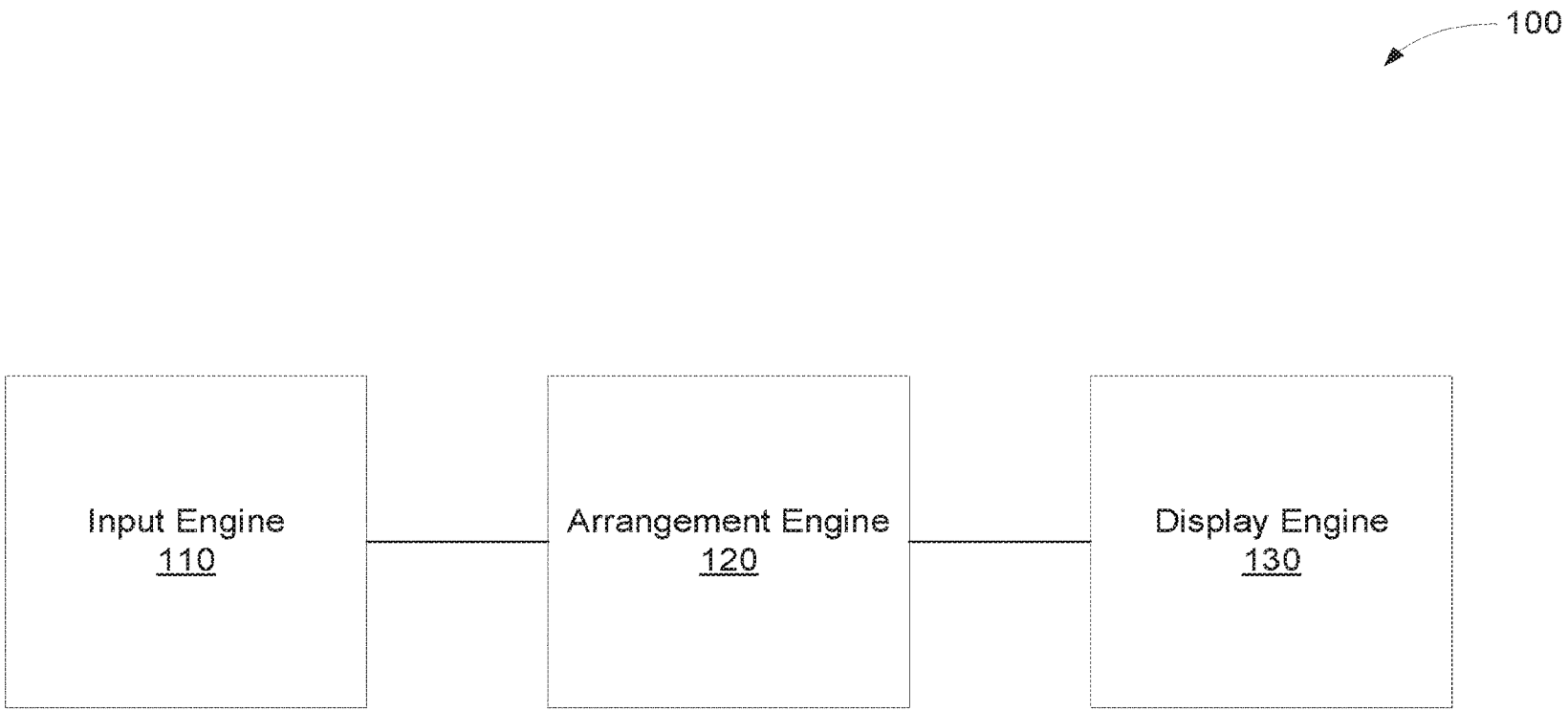
FIG. 1 is a block diagram of an example system to position video signals.

A user may have multiple computing devices. The computing device may include a desktop computer, a thin client, a notebook, a tablet, a smart phone, a wearable, or the like. To interact with the multiple computing devices, the user could have input and output devices for each computing device. Input devices connected to the computing device may include a mouse, a keyboard, a touchpad, a touch screen, a camera, a microphone, a stylus, or the like. Output devices may include a display, a speaker, headphones, a printer, or the like. However, the input and output devices may occupy much of the space available on a desk. The large number of input and output devices may be inconvenient and not ergonomic for the user. For example, the user may move or lean to use the various keyboards or mice. The user may have to turn to view different displays, and repeatedly switching between displays may tax the user. In addition, the user may be able to use a limited number of input devices and have a limited field of vision at any particular time.

User experience may be improved by connecting a single set of input or output devices to a plurality of computing devices. To prevent unintended input, the input devices may provide input to a single computing device at a time. In some examples, the output devices may receive output from a single computing device at a time. For example, the input or output devices may be connected to the plurality of computers by a keyboard, video, and mouse ("KVM") switch, which may be used to switch other input and output devices in addition to or instead of a keyboard, video, and mouse. The KVM may include a mechanical interface, such as a switch, button, knob, etc., for selecting the computing device coupled to the input or output devices. In some examples, the KVM switch may be controlled by a key combination. For example, the KVM may change the selected computing device based on receiving a key combination that is unlikely to be pressed accidentally.

Using one output device at a time, such as displaying one graphical user interface at a time, may be inconvenient for a user. For example, the user may wish to refer quickly between displays. The user experience may be improved by combining the outputs from the plurality of computing devices and providing the combination as a single output. For example, the output device may position the outputs from the plurality of computing devices in predetermined positions in the output. The output device may include black bars along the edges or top and bottom of the various outputs to compensate for variations in the size or aspect ratio of the outputs, or the output device may skew the various outputs to compensate for the variations in the size or aspect ratio of the outputs. Accordingly, the user experience may be further improved by adjusting the position, size, etc. of the outputs from the plurality of computing devices to minimize the black bars or skew of the outputs from the plurality of computing devices.

FIG. 1 is a block diagram of an example system 100 to position video signals. The system 100 may include an input engine 110. As used herein, the term "engine" refers to hardware (e.g., a processor, such as an integrated circuit or other circuitry) or a combination of software (e.g., programming such as machine-or processor-executable instructions, commands, or code such as firmware, a device driver, programming, object code, etc.) and hardware. Hardware includes a hardware element with no software elements such as an application specific integrated circuit (ASIC), a Field Programmable Gate Array (FPGA), etc. A combination of hardware and software includes software hosted at hardware (e.g., a software module that is stored at a processor-readable memory such as random access memory (RAM), a hard-disk or solid-state drive, resistive memory, or optical media such as a digital versatile disc (DVD), and/or executed or interpreted by a processor), or hardware and software hosted at hardware. The input engine 110 may determine an aspect ratio of each of a plurality of video signals input to the system 100. As used herein, the term "aspect ratio" refers to the ratio of the horizontal length of a display area to the vertical length of the display area. The length may be a physical distance, a number of pixels, or the like. The aspect ratio may be expressed as a resolution or as a reduced fraction (e.g., 4:3, 16:9, etc.). The term "display area" refers to a portion of the display that displays images. For example, the display area may include a portion of the display from which displayed screen content is visible.

The system 100 may include an arrangement engine 120. The arrangement engine 120 may determine positions in a display area for the plurality of video signals based on the aspect ratio of each video signal. For example, the arrangement engine 120 may select a first position for a first video signal with a first aspect ratio and a second position for a second video signal with a second aspect ratio. In contrast, the arrangement engine 120 may select a third position for a first video signal with a third aspect ratio and a fourth position for a second video signal with a second aspect ratio, and the third or fourth position may be different from the first or second position respectively. Accordingly, in an example, the position of either video or both may be different based on a difference in the aspect ratio of either or both video signals. As used herein, the term "position" refers to a location in the display area of at least one pixel in the video signal. In some examples, the position may be the location of a plurality of pixels, the location of all pixels in the video signal, or the location of a pixel and information usable to determine the positions of all pixels. The arrangement engine 120 may determine positions in the display that cause the plurality of video signals to not overlap.

The system 100 may include a display engine 130. The display engine 130 may output screen content corresponding to the plurality of video signals at the determined positions. For example, the display engine 130 may display the video signals at the positions determined by the arrangement engine 120. As used herein, the term "output screen content" refers to producing an output that can be registered by the visual system of a user. The display may output screen content by emitting light generated by a light source in the display, by selectively reflecting or absorbing light incident on the display, or the like.

Figure 2:
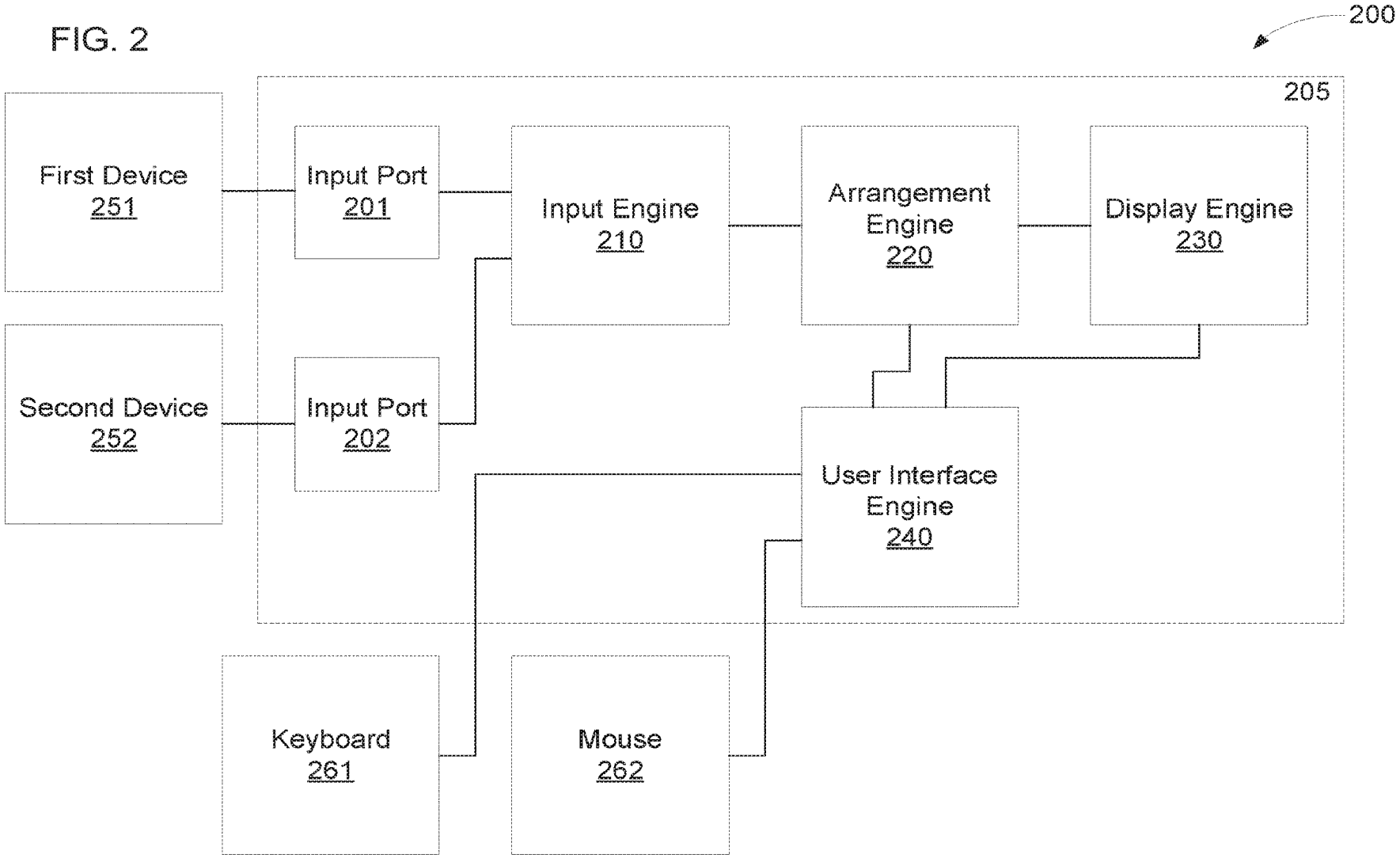
FIG. 2 is a block diagram of an environment including an example system to position video signals.

FIG. 2 is a block diagram of an environment 200 including another example system 205 to position video signals. The system 205 may include a plurality of ports 201, 202. In the illustrated example, the system 205 includes two ports and two video signals, but in other examples, the system may include three, four, six, eight, or more ports or video signals. Each port may receive one of a plurality of video signals, such as, from a first device 251 and a second device 252. In some examples, the system 205 may comprise a display device, and the ports may be input ports of the display device. The system 205 may include an input engine 210. For each of the plurality of input ports 201, 202, the input engine 210 may detect whether a video signal is present. For example, the input engine 210 may detect a voltage on a pin of the port, determine whether a message is received, or the like to detect whether the video signal is present.

The input engine 210 may determine an aspect ratio or a resolution of each of a plurality of video signals input to the system 205. In some examples, the input engine 210 may analyze the video signals to determine the aspect ratio or resolution. The input engine 210 may decode the aspect ratio or resolution from the video signal, may determine the aspect ratio or resolution by counting the number of pixels (e.g., per line, frame, field, etc.), or the like. In some examples, the input engine 210 may receive an indication of the aspect ratio or resolution in the video signal or in a distinct communication.

The system 205 may include an arrangement engine 220. The arrangement engine 220 may determine positions in a display area for the plurality of video signals based on the aspect ratio of each video signal. In some examples, the arrangement engine 220 may determine positions to minimize an amount of the display area that is blank (e.g., that does not contain a video signal). For example, the arrangement engine 220 may apply no or limited non-uniform or uniform scaling to the video signals, so the video signals may not occupy the display area completely. Accordingly, the arrangement engine 220 may determine positions of the video signals that minimize the amount of the display area that is not used to display a video signal. As used herein, the term "non-uniform scaling" refers to scaling that is not uniform scaling. The term "uniform scaling" refers to scaling that maintains an aspect ratio of the video. Non-uniform scaling may include changes in the size of the video in which the horizontal and vertical lengths are adjusted differently. For example, a multiplier to adjust the horizontal length may be different from a multiplier to adjust the vertical length (either of which multipliers may be one).

The arrangement engine 220 may determine the positions that minimize the amount of the display area that is blank based on the aspect ratios or resolutions of the video signals, the aspect ratio or resolution of the display area, the number or size of the video signals, or the like. For example, the arrangement engine 220 may determine the amount of the display area that is blank for a plurality of arrangements, and the arrangement engine 220 may select the arrangement with the smallest amount of display area that is blank. In some examples, the arrangement engine 220 may compare the aspect ratios or resolutions to thresholds (e.g., thresholds based on the aspect ratio or resolution of the display area) to determine the arrangement that minimizes the display area that is blank. The arrangement engine 220 may position video signals with a large aspect ratio (e.g., with a large horizontal length relative to vertical length) lateral to other video signals and video signals with a small aspect ratio above or below other video signals.

In an example, the arrangement engine 220 may first determine the position for a video signal with an aspect ratio most disparate from the aspect ratio of the display area and then determine the position for the video signal with the next most disparate aspect ratio and so on. When the first video signal is positioned, the aspect ratio or resolution of the display area may be updated to subtract the area occupied by the first video signal. In some examples, the arrangement engine 220 may first determine the position of a video signal least disparate from the aspect ratio of the display area, may determine the positions of the video signals substantially simultaneously, or the like. As used herein, the term "substantially simultaneously" refers to executing instructions interspersed in time to determine the positions of a plurality of video signals. For example, some instructions to determine the position of a first video signal may be executed after some instructions to determine the position of a second video signal and before other instructions to determine the position of the second video signal.

The arrangement engine 220 may determine a size of each video signal in the display area based on the aspect ratio or resolution. For example, the arrangement engine 220 may upscale or downscale a video signal to adjust the size of the video signal in the display area. The arrangement engine 220 may apply uniform or non-uniform scaling when adjusting the size of the video signal. The arrangement engine 220 may determine a larger size for video signals with a larger resolution and a smaller size for video signals with a smaller resolution. The arrangement engine 220 may determine a size that minimizes the amount of the display area that is blank. Accordingly, the size of video signals being displayed may not be strictly proportional to the resolutions of the video signals. For example, a first ratio of a size of a first video signal to a resolution of the first video signal may be different from a second ratio of a size of a second video signal to a resolution of the second video signal.

In an example, the arrangement engine 220 may determine the size based on a plurality of factors, such as the resolution, the aspect ratio, the number or size of other video signals, the amount of display area that is blank for that size, or the like. The arrangement engine 220 may increase the sizes of the video signals to fill as much as the display area as possible. For example, the arrangement engine 220 may increase the size of a video signal while maintaining the aspect ratio of the video signal. In some examples, the arrangement engine 220 may determine the size of a video signal should remain unchanged. For example, the arrangement engine 220 may determine that the video signal should be displayed using the same number of pixels as used to represent each image in the received video signal.

The arrangement engine 220 may determine an amount of non-uniform scaling to apply to the first video signal. For example, the arrangement engine 220 may stretch the video signal in the horizontal or vertical dimensions to reduce the amount of the display area that is blank. In some examples, the arrangement engine 220 may limit the amount that the scaling in one dimension can exceed the scaling in another dimension. For example, the arrangement engine 220 may limit the amount of scaling in a first dimension to no more than 0%, 1%, 2%, 5%, 10%, 20%, 50%, etc. larger than an amount of scaling in a second dimension or no more than 0, 1, 2, 5, 10, 20, 50, etc. percentage points larger than an amount of scaling in a second dimension. The arrangement engine 220 may limit the amount of non-uniform scaling so that the aspect ratio changes no more than 0%, 1%, 2%, 5%, 10%, 20%, 50%, etc. due to the scaling. In some examples, the arrangement engine 220 may determine positions, uniform or non-uniform scaling, etc. that does not cause the video signals to overlap, that causes limited overlapping, that causes substantial overlapping, or the like.

In an example, the arrangement engine 220 may not limit non-uniform scaling. The arrangement engine 220 may scale the video signals to occupy all of the display area or may scale a video signal to occupy all of a portion of the display area not occupied by other video signals. The arrangement engine 220 may attempt to minimize the average, median, maximum, etc. amount of non-uniform scaling experienced by the video signals. The arrangement engine 220 may cause the operating system at a source of a video signal to change the resolution or aspect ratio of the video signal. For example, the arrangement engine 220 may send a message instructing the operating system to do so, may send extended display identification data (EDID) that causes the operating system to use the particular resolution or aspect ratio, or the like. The arrangement engine 220 may apply the same or different scaling, limitations on non-uniform scaling, etc. to the various video signals.

In some examples, the input engine 210 may detect receipt of an additional video signal or may detect cessation of a video signal. For example, the input engine 210 may detect a voltage on a pin of the port, determine whether or not a message is received, or the like to detect the receipt of an additional video signal or cessation of a video signal. The arrangement engine 220 may determine updated positions within the display area for the plurality of remaining video signals based on the receipt of the additional video signal or cessation of the video signal. For example, the input engine 210 may detect which input ports 201, 202 have video signals in response to detecting the addition or removal of a video signal from any input port 201, 202. The arrangement engine 220 may determine positions or scaling for the detected video signals, for example, to minimize the amount of the display area that is blank. Thus, the arrangement engine 220 may automatically adjust the positions or sizes of the video signals in response to changes to the video signals being received.

The system 205 may include a display engine 230 to output screen content corresponding to the plurality of video signals at the determined position. For example, the arrangement engine 220 may be communicatively coupled to the display engine 230. The arrangement engine 220 may produce an aggregate video signal containing each of the plurality of video signals at the position and with the size determined by the arrangement engine 220. The arrangement engine 220 may provide the aggregate video signal to the display engine 230, and the display engine 230 may produce an image corresponding to the aggregate video signal. For example, the display engine 230 may emit or selectively reflect or absorb light to produce the image corresponding to the aggregate video signal.

The system 205 may include a user interface engine 240. The user interface engine 240 may receive user input. The user interface engine 240 may include buttons, may include a touch screen, or the like to receive the user input. For example, the user interface engine 240 may display an on-screen display (OSD) menu with which the user may interact. The OSD menu may include an option for adjusting the position or size of the video signals or for adjusting settings related to the position or size of the video signals. In an example, the user interface engine 240 may receive keyboard or mouse input to be passed on to sources of the video signals (e.g., from keyboard 261 and mouse 262). The user interface engine 240 may determine when a user input is intended to adjust the position or size of the video signal, for example, when a mouse click is on a corner or edge of the displayed video signal. Alternatively, or in addition, the user interface engine 240 may detect a particular key combination, click combination, etc. that indicates to the user interface engine 240 to enter a mode in which the user may adjust the position or size of video signals.

The arrangement engine 220 may adjust the positions of the plurality of video signals based on the user input. For example, the user may explicitly indicate a position or size for a video signal, may indicate a precedence of a video signal, may indicate criteria for selecting the position or size of the plurality of video signals, or the like. The user may indicate that a particular video signal should be located in, e.g., an upper left hand corner of the display area. The user may use a cursor or touch to indicate a position, to stretch the video signal to a particular size, or the like. The user may select a primary video signal or rank the video signals in order of importance. The arrangement engine 220 may place higher ranked video signals in higher ranked positions and use a larger size or distort the aspect ratio less for higher ranked video signals than for lower ranked video signals. The rank of positions may be factory specified rankings, user indicated rankings, or the like. The user may indicate a maximum amount of uniform or non-uniform scaling that can be applied to videos. For example, the user may indicate that a video signal should receive no non-uniform scaling. In an example, highly ranked video signals may receive no or limited non-uniform scaling. The user may indicate that a first video signal should be displayed using an entirety of one dimension of the display area. The arrangement engine 220 may cause the first video signal to occupy the entirety of that dimension. The arrangement engine 220 may select the length of the first video signal in a second dimension based on the original aspect ratio, may apply non-uniform scaling to provide additional space for other video signals, or the like. The arrangement engine 220 may position the other video signals in a portion of the display area not occupied by the first video signal, may position the other video signals to partially or entirely overlap with the first video signal, or the like.

The user interface engine 240 may receive a user input indicating that a video signal should be reduced in size and overlap a portion of another video signal. The arrangement engine 220 may reduce a second video signal in size display the second video signal over a portion of the first video signal. For example, the arrangement engine 220 may display the second video signal as a thumbnail entirely overlapping a portion of the first video signal. In some examples, the arrangement engine 220 may display the second video signal in a size larger than a thumbnail. The arrangement engine 220 may display the second video signal in the reduced size adjacent to the first video signal, partially overlapping a portion of the first video signal, entirely overlapping a portion of the first video signal, or the like. In an example, the user interface engine 240 may detect a user input indicating the second video signal should be enlarged or repositioned, such as based on a particular key combination, a user clicking and dragging a location corresponding to the second video signal, a user single, double, triple, etc. clicking but not dragging the second video signal, or the like. The arrangement engine 220 may enlarge the second video signal based on the detection by the user interface engine 240. For example, the arrangement engine 220 may restore the second video signal to a previous size or position similar to the position or size prior to the second videos signal being reduced to thumbnail size. In some examples, the arrangement engine 220 may detect a change in the second video signal and increase the size of the second video signal temporarily or permanently based on the detected change. For example, a video signal from a computer (e.g., a desktop, a notebook, a mobile phone, a tablet, etc.) may change when a call, a text, an email, a chat, a push notification, or the like is received. The arrangement engine 220 may detect how much of the video signal changed (e.g., how many pixels) determine whether to increase the size of the video signal based on whether the change exceeds a threshold. In an example, a source of the second video signal may detect receipt of a communication (e.g., a call, a text, an email, a chat, a push notification, or the like) and indicate to the arrangement engine 220 to change the size or position of the second video signal.

Figure 3:
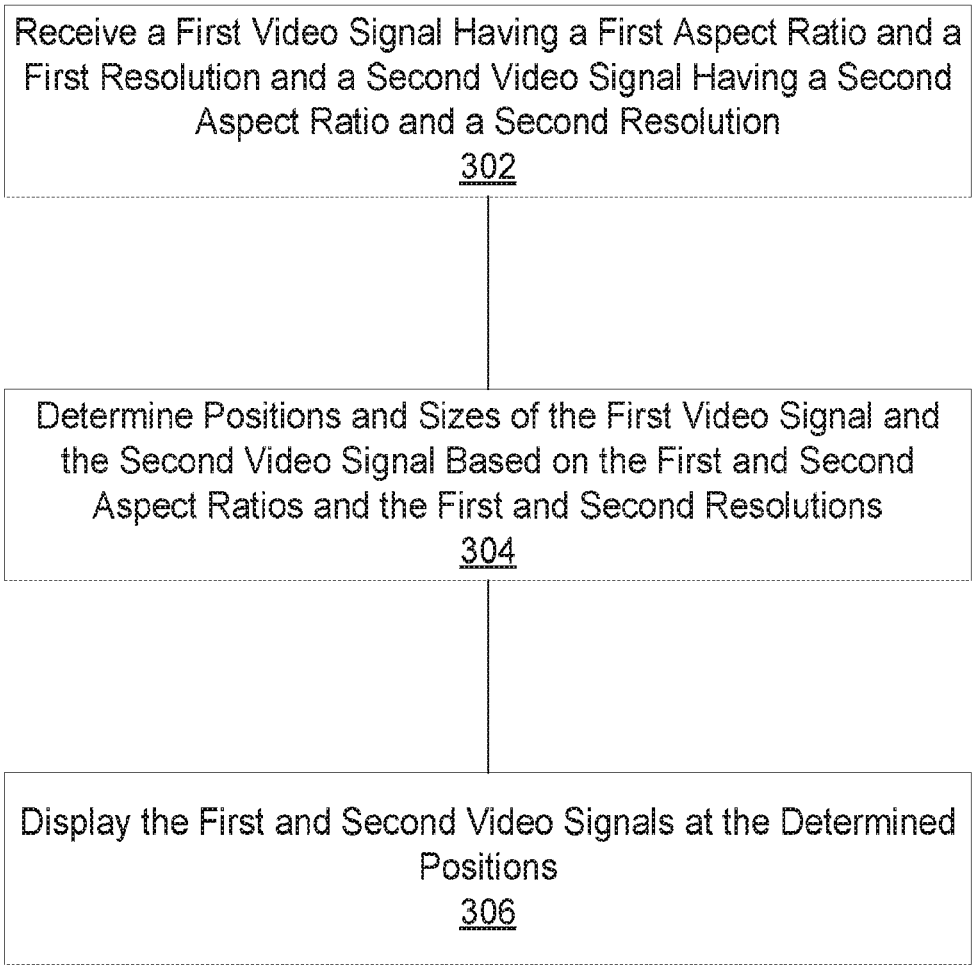
FIG. 3 is a flow diagram of an example method to position video signals.

FIG. 3 is a flow diagram of an example method 300 to position video signals. A processor may perform the method 300. At block 302, the method 300 may include receiving a first video signal having a first aspect ratio and a first resolution and a second video signal having a second aspect ratio and a second resolution. The first and second aspect ratio may be the same as each other or different from each other. Similarly, the first and second resolution may be the same as each other or different from each other. In some examples, the first and second video signals may be received from a remote device.

At block 304, the method 300 may include determining positions and sizes of the first video signal and the second video signal within a display area based on the first and second aspect ratios and the first and second resolutions. For example, the aspect ratios or the resolutions may be analyzed to determine how to position the first and second video signals within the display area or how to size the first and second video signals. Block 306 may include displaying the first and second video signals at the determined positions and sizes. For example, the first and second video signals may positioned and sized in the display area according to the determination at block 304. Referring to FIG. 1, in an example, the input engine 110 may perform block 302, the arrangement engine 120 may perform block 304, and the display engine 130 may perform block 306.

Figure 4:
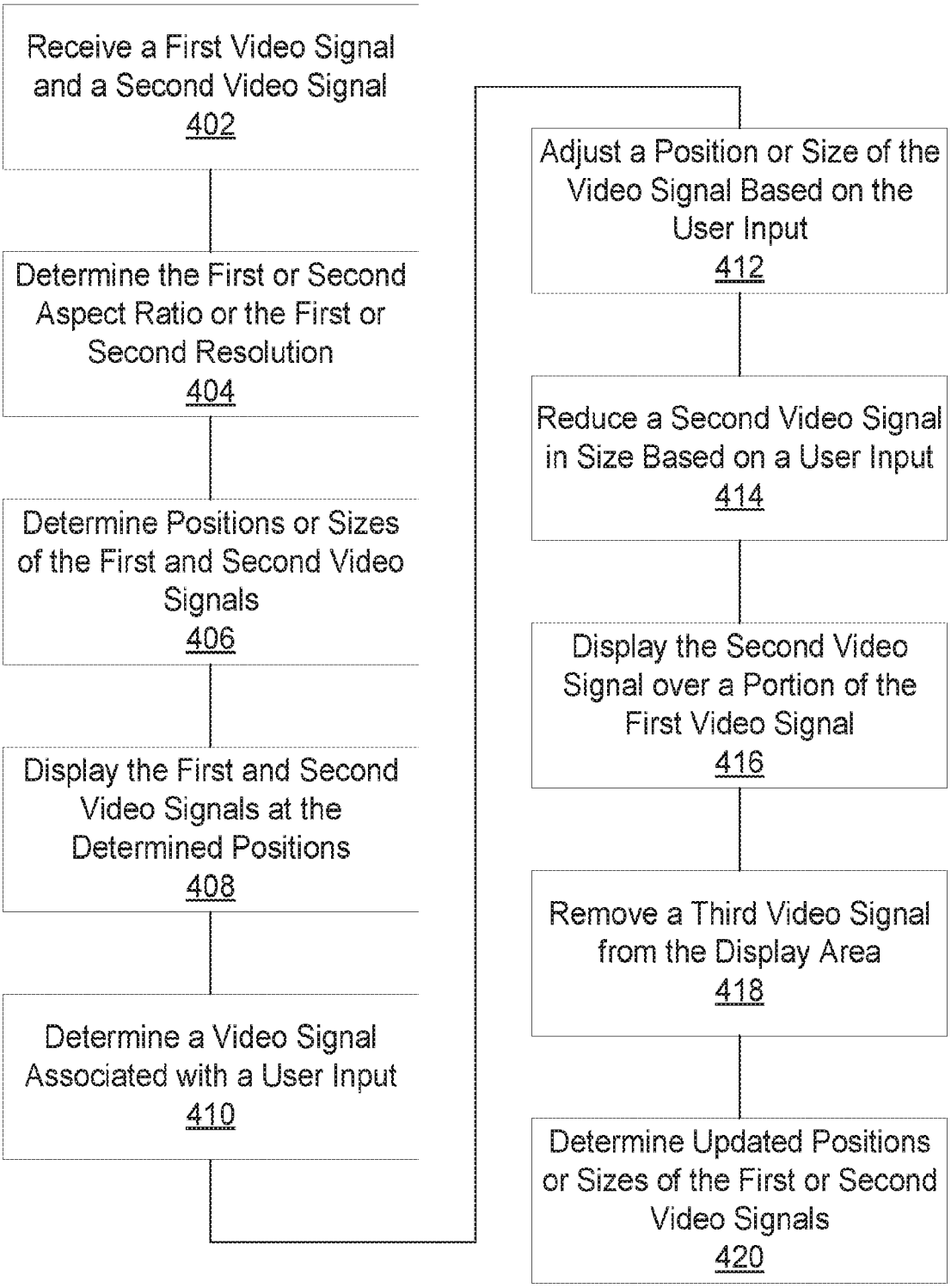
FIG. 4 is a flow diagram of an example method to position video signals.

FIG. 4 is a flow diagram of another example method 400 to position video signals. A processor may perform the method 400. At block 402, the method 400 may include receiving a first video signal having a first aspect ratio and a first resolution and a second video signal having a second aspect ratio and a second resolution. For example, the first and second video signals may be received by the display device from remote devices, may be generated by the display device, or the like.

At block 404, the method 400 may include determining the first aspect ratio or the first resolution of the first video signal or the second aspect ratio or the second resolution of the second video signal. For example, the aspect ratios or resolutions may be received from sources of the video signals, may be indicated explicitly in the first or second video signals, may be determined by analyzing the first or second video signals, or the like. The aspect ratios or resolutions may be determined when the video signals are initially received, periodically, aperiodically, when changes in the video signals are detected, or the like.

Block 406 may include determining positions or sizes of the first video signal and the second video signal within a display area based on the first and second aspect ratios and the first and second resolutions. For example, the positions or sizes may be determined to minimize an amount of the display area that is blank. Determining the sizes may include determining an amount of uniform or non-uniform scaling to apply to the video signals. The size may be determined based on the resolution. Larger sizes may be determined for video signals with larger resolutions compared to video signals having smaller resolutions. The position or size may be determined based on user or default settings. For example, the user may indicate an order of importance of the video signals, limitations on the amount of scaling that can be applied, or the like. In an example, a user or default setting may limit an amount of scaling in a first dimension to no more than 0%, 1%, 2%, 5%, 10%, 20%, 50%, etc. larger than an amount of scaling in a second dimension or no more than 0, 1, 2, 5, 10, 20, 50, etc. percentage points larger than an amount of scaling in a second dimension. At block 408, the method 400 may include displaying the first and second video signals at the determined positions with the determined sizes. For example, the display device may emit or selectively reflect or absorb light to display the first and second video signals in determined positions of the display area with the determined sizes.

Block 410 may include determining a video signal associated with a user input. In some examples, user inputs may be provided to the sources of the video signals. For example, it may be determined which source should receive each user input, and the user input may be provided to that source. Some inputs may be intended for adjusting the positions or sizes of the video signals rather than for the sources of the video signals. Such inputs may include particular key combinations, touches or mouse clicks on an edge or corner of the displayed video signals, particular combinations of mouse clicks or touches/gestures, or the like. It may be determined that the user input is to adjust the position or size of the video signal based on the location of the user input, the contents of the user input, or the like. Determining the video signal associated with the user input may include determining the video signal based on the particular key, touch, gesture, or mouse click combination, based on the edge or corner on which the user clicked or touched, or the like. In an example, a first user input may indicate a position or size of a video signal is to be modified, and a second user input may indicate which video signal is to be modified or whether a size or position is to be modified. In an example, the user input may be received by a button on the display device. The user input may include a selection of a menu option to adjust the position or size of a video signal. There may be ambiguity as to which video signal is intended when a user interacts with an edge or corner shared by multiple video signals. In such cases, the interaction may be applied to all video signals sharing the edge or corner, may be applied to a video signal that most recently received a previous user input, or may cause a prompt requesting the user indicate the intended video signal.

At block 412, the method 400 may include adjusting a size or position of the video signal based on the user input.

For example, the user may click and drag, touch and drag, or the like an edge or corner of a first displayed video signal. The user may gesture on the first video signal, enter a particular key combination, press a button on the display device, etc. to indicate a desired repositioning or resizing. In response, the position or size of the first video signal may be adjusted as well as the position or size of other video signals affected by the repositioning or resizing of the first video signal. The first video signal may be adjusted as indicated by the user. Positions and sizes for the other video signals may be determined to minimize the amount of display area that is blank, and the other video signals may be repositioned and resized accordingly.

At block 414, the method 400 may include reducing a second video signal in size, for example, based on receiving user input indicating the second video signal should be reduced in size. For example, a user may wish to free up space used by the second video signal while still leaving the second video signal available for quick access. Thus, the second video signal may be reduced in size to a thumbnail size or larger or smaller than a thumbnail size. Block 416 may include displaying the second video signal over a portion of the first video signal. To further free space, the reduced size second video signal may be positioned over a portion of the first video signal. The second video signal may be positioned where it is unlikely to obstruct areas of interest in the first video signal. For example, the second video signal may be positioned near a corner of the display, such as an upper right corner for users who read left-to-right. In some examples, the second video signal may be restored to a full size or repositioned based on a user input, an indication from a source of the second video signal (e.g., the source detecting receipt of a communication), the second video signal meeting a particular criterion (e.g., more than a threshold number of pixels changing), or the like.

Block 418 may include removing a third video signal from the display area. The third video signal may be removed based on receiving a user input indicating to do so, based on the third video signal no longer being received, based on the third video signal not containing content, or the like. For example, it may be detected that the third video signal is no longer being received, is all black, is displaying a screen saver or lock screen, or the like. Removing the third video signal may include discontinuing display of the third video signal in the portion of the display area allocated to the third video signal. At block 420, the method 400 may include determining updated positions or sizes of the first video signal or the second video signal within the display area. For example, determining updated positions or size may include determining positions or sizes that minimize the amount of the display area not including content. The third video signal may be disregarded when determining the updated positions or sizes. Accordingly, larger sizes or more preferred positions may be provided to the first or second video signal based on the removal of the third video signal. In an example, the input ports 201, 202 or the input engine 210 of FIG. 2 may perform block 402; the input engine 210 may perform block 404; the arrangement engine 220 may perform blocks 406, 412, 414, 416, 418, or 420; the display engine 230 may perform blocks 408 or 416; or the user interface engine 240 may perform block 410.

Figure 5:
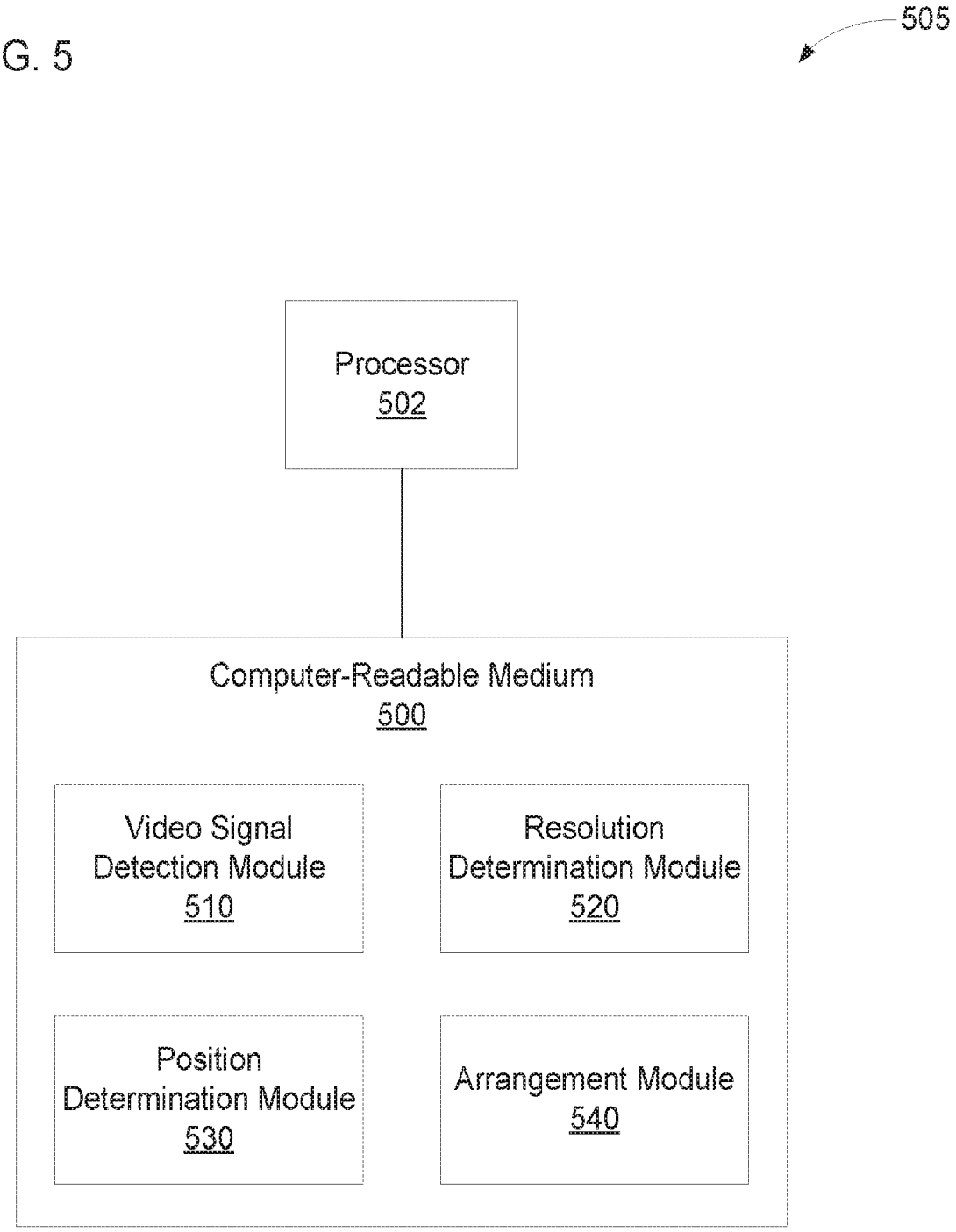
FIG. 5 is a block diagram of an example system to position video signals.

FIG. 5 is a block diagram of an example system 505 to position video signals. The system 505 may include a computer-readable medium 500 including instructions that, when executed by a processor 502, cause the processor 502 to position the video signals in a display area of a display. The computer-readable medium 500 may be a non-transitory computer-readable medium, such as a volatile computer-readable medium (e.g., volatile RAM, a processor cache, a processor register, etc.), a non-volatile computer-readable medium (e.g., a magnetic storage device, an optical storage device, a paper storage device, flash memory, read-only memory, non-volatile RAM, etc.), and/or the like. The processor 502 may be a general purpose processor or special purpose logic, such as a microprocessor, a digital signal processor, a microcontroller, an ASIC, an FPGA, a programmable array logic (PAL), a programmable logic array (PLA), a programmable logic device (PLD), etc.

The computer-readable medium 500 may include a video signal detection module 510. As used herein, a "module" (in some examples referred to as a "software module") is a set of instructions that when executed or interpreted by a processor or stored at a processor-readable medium realizes a component or performs a method. The video signal detection module 510 may include instructions that, when executed, cause the processor 502 to detect for each of a plurality of input ports whether a video signal is present. For example, the video signal detection module 510 may cause the processor 502 to determine what voltage is present on a pin of an input, determine whether a message is received at the input port, or the like to determine whether a video signal is present on that port.

The computer-readable medium 500 may include a resolution determination module 520. The resolution determination module 520 may cause the processor 502 to determine a resolution of each video signal detected to be present. For example, the resolution determination module 520 may cause the processor 502 to receive an indication of the resolution from a source of the video signal, analyze the video signal to determine the resolution, or the like.

The computer-readable medium 500 may include a position determination module 530. The position determination module 530 may cause the processor 502 to determine positions in a display area for each video signal based on the resolution of each video signal. For example, the position determination module 530 may cause the processor 502 to determine positions for the video signals that minimize the amount of the display area that is blank. The computer-readable medium 500 may include an arrangement module 540. The arrangement module 540 may cause the processor 502 to arrange the video signals based on the determined positions. For example, the arrangement module 540 may map the video signals to the correct pixels of the display based on the determined positions. In an example, when executed by the processor 502, the video signal detection module 510 or the resolution determination module 520 may realize the input engine 110 of FIG. 1, and the position determination module 530 or the arrangement module 540 may realize the arrangement engine 120.

Figure 6:
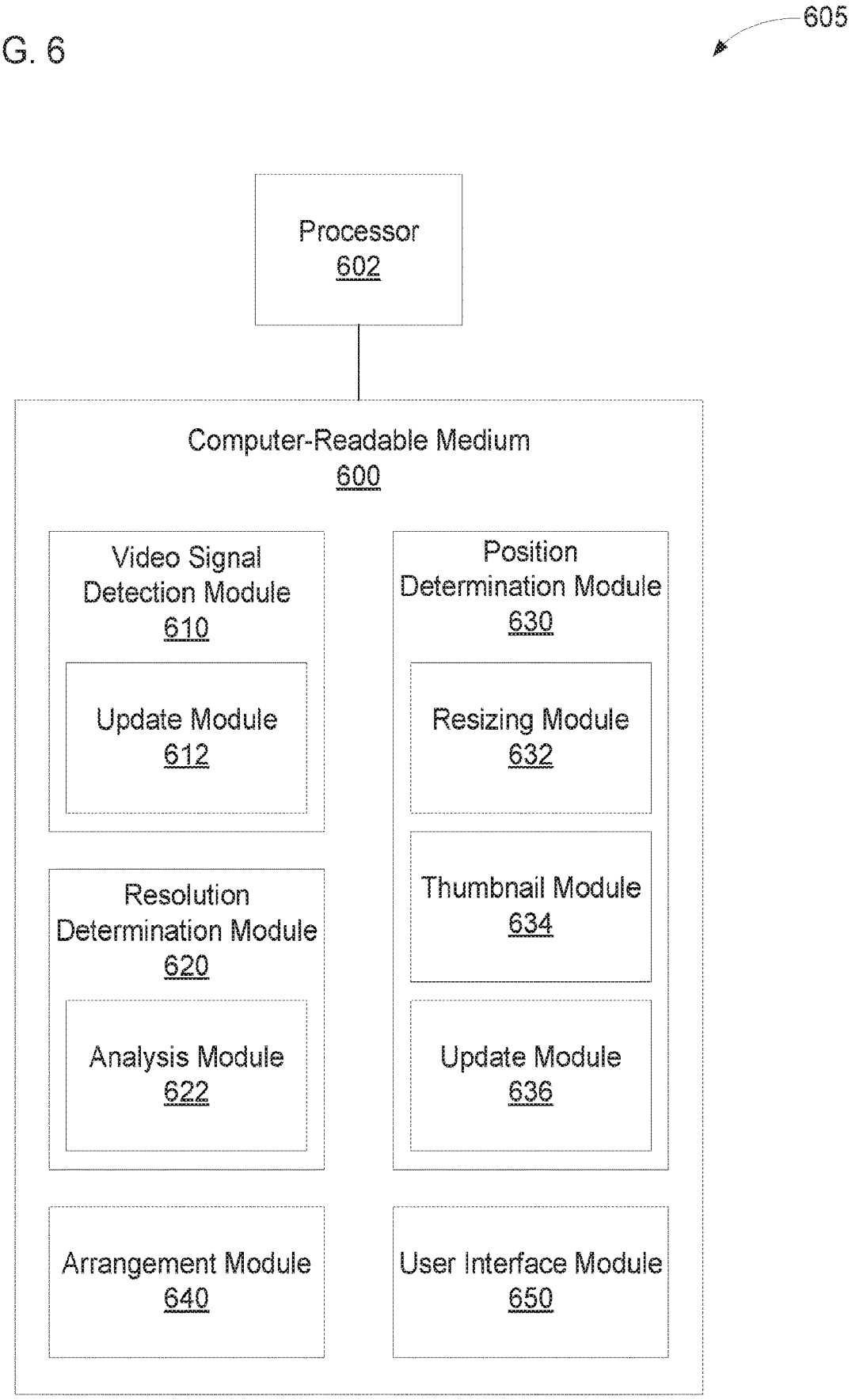
FIG. 6 is a block diagram of an example system to position video signals.

FIG. 6 is a block diagram of an example system 605 to position video signals. The system 605 may include a computer-readable medium 600 including instructions that, when executed by a processor 602, cause the processor 602 to position video signals in a display area of a display. The computer-readable medium 600 may include a video signal detection module 610. The video signal detection module 610 may include instructions that, when executed, cause the processor 602 to detect for each of a plurality of input ports whether a video signal is present. For example, the display device may include the plurality of input ports. Each input port may be able to receive a video signal but may be disconnected from a source of video signals, may be connected to a source not transmitting a video signal, may be connected to a source transmitting a blank video signal (e.g., an all-black video signal, a video signal containing white noise, a video signal containing static text, etc.), or the like. The video signal detection module 610 may cause the processor 602 to detect whether a source is connected, whether a video signal is being received from the source, whether a non-blank video signal is being received, or the like. The video signal detection module 610 may cause the processor 602 to directly or indirectly determine what voltage is present on a pin of an input, determine whether a message is received at the input port, or the like to determine whether a video signal is present on that port. The video signal detection module 610 may cause the processor 602 to analyze the video signal to determine whether the video signal is blank.

The video signal detection module 610 may include an update module 612. The update module 612 may cause the processor 602 to detect addition of a video signal or cessation of a video signal. For example, the update module 612 may cause the processor 602 to continually monitor the input ports to detect the addition or cessation of video signals. The update module 612 may cause the processor 602 to periodically determine whether a voltage is present on a pin of the input port, a message has been received from a source of the video signal, or a video signal is blank. In an example, the update module 612 may cause the processor 602 to detect the video signal by handling an interrupt issued in response to the addition or cessation of the video signal.

The computer-readable medium 600 may include a resolution determination module 620. The resolution determination module 620 may cause the processor 602 to determine a resolution of each video signal detected to be present. The resolution determination module 620 may cause the processor 602 to receive an indication of the resolution from the source, determine the resolution based on the video signal, or the like. The resolution determination module 620 may include an analysis module 622. The analysis module 622 may cause the processor 602 to determine the resolution of each video signal by analyzing that video signal. For example, the analysis module 622 may cause the processor 602 to extract an indication of the resolution from the video signal, to count the number of pixels per line, frame, etc., or the like.

The computer-readable medium 600 may include a position determination module 630. The position determination module 630 may cause the processor 602 to determine positions in a display area for each video signal based on the resolution of each video signal. For example, the position determination module 630 may cause the processor 602 to arrange the video signal in the display area to minimize an amount of the display area that is blank. The position determination module 630 may cause the processor 602 to also, or instead, adjust the size of the video signals with uniform or non-uniform scaling to minimize the amount of the display area that is blank.

The computer-readable medium 600 may include an arrangement module 640. The arrangement module 640 may cause the processor 602 to arrange the video signals based on the determined positions. The arrangement module 640 may scale the video signals based on the determined sizes. The arrangement module 640 may cause the processor 602 to map the video signals (e.g., the scaled video signals) to display pixels based on the determined positions. The arrangement module 640 may cause the processor 602 to arrange the video signals by temporarily storing the video signals in buffers with positions selected based on the positions or sizes, by transmitting the video signals to the display pixels based on the positions or sizes (e.g., via gate and data lines), or the like. In some examples, the arrangement module 640 may cause the processor 602 to cause the display device to display the video signals in the determined positions.

The computer-readable medium 600 may include a user interface module 650. The user interface module 650 may cause the processor 602 to receive and respond to user input. In an example, the user interface module 650 may cause the processor 602 to receive a user input indicating that a first video signal should be displayed using an entirety of one dimension of the display area. For example, the user may indicate that the first video signal should occupy the entirety of the vertical dimension of the display area, the entirety of the horizontal dimension of the display area, or both. The position determination module 630 may include a resizing module 632. The resizing module 632 may cause the processor 602 to determine updated positions in which the first video signal occupies an entirety of one dimension of the display area based on the user input. For example, the resizing module 632 may cause the processor 602 to determine a second dimension for the first video signal based on the first dimension occupying the entirety of the corresponding dimension of the display area. The resizing module 632 may also cause the processor 602 to determine positions or sizes for the remaining video signals based on the position or size of the first video signal.

The user interface module 650 may cause the processor 602 to receive a user input indicating that a second video signal should be thumbnail sized. In an example, a single input may indicate both that the first video signal should occupy the entirety of one dimension of the display area and that the second video signal should be thumbnail sized. The input may or may not indicate that the second video signal should overlap a portion of the first video signal. The position determination module 630 may include a thumbnail module 634. The thumbnail module 634 may cause the processor 602 to determine updated positions in which the second video signal is thumbnail sized based on the user input. For example, the thumbnail module 634 may cause the processor 602 to determine a position of the second video signal, such as a position overlapping the first video signal that is unlikely to obstruct important portions of the first video signal. The thumbnail module 634 may also, or instead, cause the processor 602 to determine updated positions or sizes for video signals other than the second video signal to occupy at least some of the area vacated by the second video signal (e.g., to minimize the amount of the display area that is blank).

The position determination module 630 may include an update module 636. The update module 636 may cause the processor 602 to determine updated positions within the display area for a plurality of remaining video signals based on addition or cessation of a video signal (e.g., cessation of the first video signal). For example, the update module 612 may cause the processor 602 to indicate the addition or cessation of the video signal to the update module 636. The update module 636 may cause the processor 602 to receive an indication of the resolution of any added video signals from the resolution determination module 620. The update module 636 may cause the processor 602 to determine positions or sizes of the remaining video signals to minimize an amount of the display area that is blank. For example, based on removal of a video signal, the update module 636 may cause the processor 602 to adjust the positions or sizes of the remaining video signals to occupy the vacated space. Based on addition of a video signal, the update module 636 may cause the processor 602 to adjust the positions or sizes of the remaining video signals to vacate space for the added video signal and to determine a position or size for the added video signal.

The above description is illustrative of various principles and implementations of the present disclosure. Numerous variations and modifications to the examples described herein are envisioned. Accordingly, the scope of the present application should be determined only by the following claims.

What is claimed is:

1. A system comprising:

a plurality of input ports to receive a plurality of video signals;

an input engine to determine an aspect ratio of each video signal by analyzing each video signal received by the plurality of input ports;

an arrangement engine to determine positions in a display area for the plurality of video signals based on the aspect ratio of each video signal; and a display engine to output screen content corresponding to the plurality of video signals at the determined positions.

2. The system of claim 1, wherein the arrangement engine is to determine positions to minimize an amount of the display area that is blank.

3. The system of claim 1, wherein the input engine is to determine a resolution of each of the plurality of video signals, and wherein the arrangement engine is to determine a size of each video signal in the display area based on the resolution.

4. The system of claim 3, wherein a first ratio of a size of a first video signal to a resolution of the first video signal is different from a second ratio of a size of a second video signal to a resolution of the second video signal.

5. The system of claim 1, further comprising a user interface engine to receive a user input, wherein the arrangement engine is to adjust the positions of the plurality of video signals based on the user input.

6. A method to position video signals, the method comprising:

receiving, by a processor, a first video signal comprising a first aspect ratio and a first resolution and a second video signal comprising a second aspect ratio and a second resolution;

analyzing, by the processor, the first video signal to determine the first resolution and the second video signals to determine the second resolution;

determining, by the processor, positions and sizes of the first video signal and the second video signal within a display area based on the first and second aspect ratios and the first and second resolutions; and displaying, by the processor, the first and second video signals at the determined positions and sizes.

7. The method of claim 6, wherein determining the positions and sizes comprises determining an amount of non-uniform scaling to apply to the first video signal, wherein determining the amount of non-uniform scaling comprises limiting an amount of scaling in a first dimension to no more than 10% larger than an amount of scaling in a second dimension.

8. The method of claim 6, further comprising determining a video signal associated with a user input, and adjusting a size or position of the video signal based on the user input.

9. The method of claim 6, further comprising based on a user input, reducing the second video signal in size and displaying the second video signal over a portion of the first video signal.

10. The method of claim 6, further comprising based on a user input, removing a third video signal from the display area and determining updated positions and sizes of the first video signal and the second video signal within the display area.

11. A non-transitory computer-readable medium comprising instructions that, when executed by a processor, cause the processor to:

detect for each of a plurality of input ports whether a video signal is present;

determine a resolution of each video signal by analyzing each video signal detected to be present;

determine positions in a display area for each video signal based on the resolution of each video signal; and arrange the video signals based on the determined positions.

12. The computer-readable medium of claim 11, further comprising instructions that cause the processor to, based on a user input, determine updated positions in which a first video signal occupies an entirety of one dimension of the display area.

13. The computer-readable medium of claim 12, wherein the instructions cause the processor to determine updated positions in which a second video signal is thumbnail sized based on the user input.

14. The computer-readable medium of claim 11, further comprising instructions that cause the processor to detect cessation of a first video signal, and determine updated positions within the display area for a plurality of remaining video signals based on cessation of the first video signal.

15. The computer-readable medium of claim 11, wherein the instructions to cause the processor to determine the resolution include instructions to cause the processor to determine the resolution of each video signal by analyzing that video signal.

* * * * *